United States Patent [19]

Flynn

[11] 4,133,636

[45] Jan. 9, 1979

[54] TENTOR

[75] Inventor: Charles S. Flynn, Muskegon, Mich.

[73] Assignee: Blu-Surf, Inc., Muskegon, Mich.

[21] Appl. No.: 811,583

[22] Filed: Jun. 30, 1977

[51] Int. Cl.[2] ..... F23J 5/00

[52] U.S. Cl. ..... 432/72; 34/35; 34/158; 432/222

[58] Field of Search ..... 432/72, 222; 34/35, 34/158

[56] References Cited

U.S. PATENT DOCUMENTS

| | | | |
|---|---|---|---|
| 1,603,760 | 10/1926 | Furkert | 34/35 |
| 2,083,141 | 6/1937 | Buck | 34/158 |
| 3,436,065 | 4/1969 | Flynn | 432/9 |
| 3,744,963 | 7/1973 | Flynn | 432/59 |
| 3,882,612 | 5/1975 | Try et al. | 432/72 |
| 3,917,444 | 11/1975 | Cathew | 34/35 |

*Primary Examiner*—John J. Camby

*Attorney, Agent, or Firm*—Price, Heneveld, Huizenga & Cooper

[57] ABSTRACT

An oven for treating web stock, especially a tentor for treating textile fabric, to remove volatile combustible substances therefrom in a manner that results in more rapid operation with less capital outlay for equipment, less fuel consumption, and controlled stack discharge. The oven employs a recycle circuit in which the temperature of the oven discharge gaseous stream is first raised by combustion of the volatilized substances therein, and then lowered by entry of cooler, supplemental air, after which part of the gaseous stream is returned to the oven and part used for stock preheating or post heating in other oven sections.

11 Claims, 6 Drawing Figures

TENTOR

BACKGROUND OF THE INVENTION

This invention relates to an oven for treating web stock, especially cloth stock in a tentor frame, and more particularly to such having special gaseous recycling.

In the typical treatment of textile fabric during manufacture thereof, a generally continuous web of fabric is ultimately passed through a tentor frame for stretching and drying of the textile held by tentor hooks or the equivalent along the edges of the web. Heated gases are forced over and through the stretched fabric in substantial volumes for drying. During this process, the temperature of the gases must be limited to a predetermined maximum to avoid damage to the fabric due to overheating during drying or during the post-drying heat treatment. Consequently, it is typically necessary to have several tentor frame dryer sections in series to achieve effective drying and post-drying heat treatment. Such equipment requires substantial capital outlay, space, and heat input. A great share of this generated heat is exhausted to the atmosphere and lost in the volumes of gases discharged. These gases are laden with varying amounts of liquids removed from the fabric during drying. When processing double knit fabrics, such liquids typically include oily compounds deposited on the fabric during the previous knitting operation, solvents, and carriers for the dyes. These are carried by the drying gases, in minute form and often partially combusted, into the atmosphere as smoke and fine mist. This of course is not ecologically desirable. Furthermore, some of the oily substance has a tendency to condense and coat the equipment interior and cause potential problems and fabric damage.

In sum, it is recognized in the trade that present tentor dryer equipment, though effective, is expensive and space consuming to the fabric mills. Not only the fabric mills, but also the public in general is encumbered with higher fuel costs and fabric costs due to the tremendous quantities of fuel necessary for the tentor dryers. And the public also has the ecological disadvantage of undesirable stack discharges. Though such discharges are questionable as to meeting governmental guidelines, the mills have not heretofore had available to them tentor dryers that are effective in this regard.

SUMMARY OF THE INVENTION

The present invention effectuates more efficient and rapid drying and heat treatment of web stock, particularly textile fabric, in a tentor, using less fuel and less equipment, and resulting in ecologically improved, controlled stack discharge. Using the invention, moisture and oil compounds are removed from textile fabric such as knitted polyester materials in a fashion significantly reducing fuel consumption and curbing pollution-causing stack discharge. With the special flow circuit and apparatus of the invention, the combustible volatile oil, solvent, and carrier type materials removed from the textile material during evaporation of the moisture are combusted in a special chamber, at a relatively higher temperature, the resulting gases being subsequently cooled with supplemental fresh air, with part of the gaseous stream then being returned to the oven for evaporation of moisture and oil products from additional web stock, and for preheating and/or post heating of the stock.

An advantageous feature of the invention is its adaptability to existing equipment, particularly tentor frames presently used for drying and heat treating of cloth. The invention renders available to textile mills the capacity to control stack discharge for curbing air pollution of combustible materials to meet pollution control standards. Yet, the amount of actual equipment is considerably lessened over that previously required, rather than increased as might be expected. And, furthermore, fuel requirements are markedly lowered from previous requirements. Experimental operation on a trial basis under actual textile mill conditions shows that the invention enables substantial fuel conservation, increased production rates and/or less equipment for present production rates, and curbed stack output for pollution control.

Conversion of even existing tentor apparatus is accomplished without great difficulty and with immediate benefits.

Because the invention was conceived and developed for drying and heat treating of textile stock, and is particularly useful for such, it will be described herein chiefly in this context. However, it is believed that the concept in its broader aspects could be adapted to heat treatment of other web stock also where combustible pollutants are driven off the stock, e.g. paper, wood, polymer stock and the like.

These and several other advantages, features and objects of the invention will be apparent upon reviewing the following detailed disclosure.

DESCRIPTION OF THE PREFERRED EMBODIMENT

The manufacture of cloth fabric at textile mills typically involves use of a tentor or tentor frame by which the fabric is stretched and heated to dry the fabric, and usually to heat treat the fabric. Treatment of double knit polyester fabric, for example, typically involves removal of moisture quantities of 15 to 40% by weight and heat treating the fabric, both while the fabric is in a stretched condition. In this type of operation, temperatures of 350° to 375° F. should not be exceeded, to avoid damage to the fabric by fusion or the like.

It is significant that, during the formation of the fabric as by knitting, oils and solvents such as needle oil, sludge solvents, metallic cleaners and other organic compounds, are typically employed. As the polyester knit cloth is dried in the conventional tentor, smoke is emitted as a result of the oils and solvents present in the cloth and volatilized therefrom by the heated drying gases. Some of this oily material recondenses inside the tentor housing, some of it recondenses on the roof areas of the building at the stacks, and some is ejected into the atmosphere as smoke to the disadvantage of personnel, plants, and structures in the area.

The degree of effectiveness of conventional tentors in drying and heat treating cloth is dependent upon flow of vast quantities of hot gases. The gases are heated to approximately 350° to 375° F., passed over the stock, and exhausted at temperatures of approximately 250° F. These tentor units are typically formed of ten foot length sections, each several feet wide. The fabric is stretched, for example, from a width of about 48 inches to about 63 inches or so, during which and subsequent to which several pounds of water per minute are evaporated for lowering the moisture content from about 15 to 40% by weight to a few percent. This also results in evaporation of substantial quantities of knitting oil (light machine oil), solvents, dye carriers and other chemicals from the fabric. The discharge from these tentor units results in tremendous heat loss up the stack. Increased fuel costs in recent years has rendered these heat losses very serious. Further, meeting recent pollution control standards has been all but impossible with equipment heretofore available to the textile mills.

Experimentation employing the present inventive concept was conducted in an actual operating textile mill. One experiment involved conversion of two specific zones of a conventional seven zone tentor. The converted system was operated for several months to determine and solve problem areas, and to reduce the invention to practice. The results were exciting and encouraging, both to the inventor hereof and the managing personnel of the mill.

Figure 5:
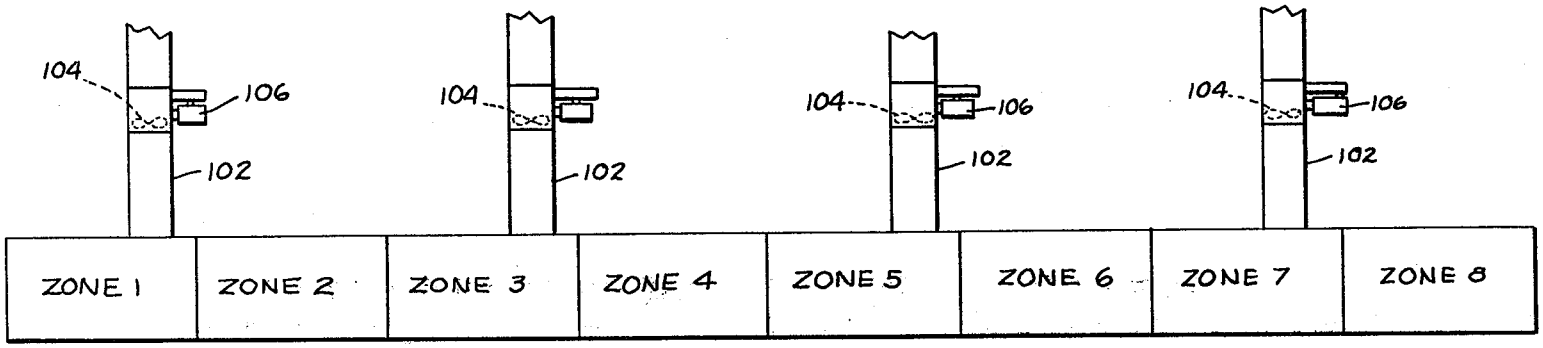
PRIOR ART FIG. 5.
FIG. 5 is an elevational view of a conventional eight zone tentor which was replaced by the apparatus in FIG. 1.

Referring now specifically to the drawings, the prior art apparatus depicted in FIG. 5 constitutes a typical eight zone tentor through which the cloth stock in web form would flow for removal of moisture from the cloth as the cloth is held stretched on a tentor frame. Hot gases are normally used for drying and also to heat treat the fabric. The temperature of the inflowing gases is usually between about 350° and 375° F.

Typically, each zone of a conventional tentor of the type employed, such as an "Artos" brand unit, will exhaust from about 6,000 to about 8,500 cubic feet per minute of hot gases at a temperature of about 300° F. to 360° F. If the flow rates are allowed to drop to less than about 4,000 cubic feet per minute, the oil evaporated from the cloth will tend to recondense in the equipment, to cause problems within the equipment and on the fabric itself. To attempt to incinerate the vaporized products in this volume of air would require more heat input than for the drying process itself. This necessity for such tremendous amounts of air limits the production from the apparatus and causes substantial heat losses. The hot exhaust gases are vented from multiple zones of the conventional tentor 100 through a series of exhaust stacks 102, each typically including an exhaust fan 104 and motor 106 therefor.

Figure 4:
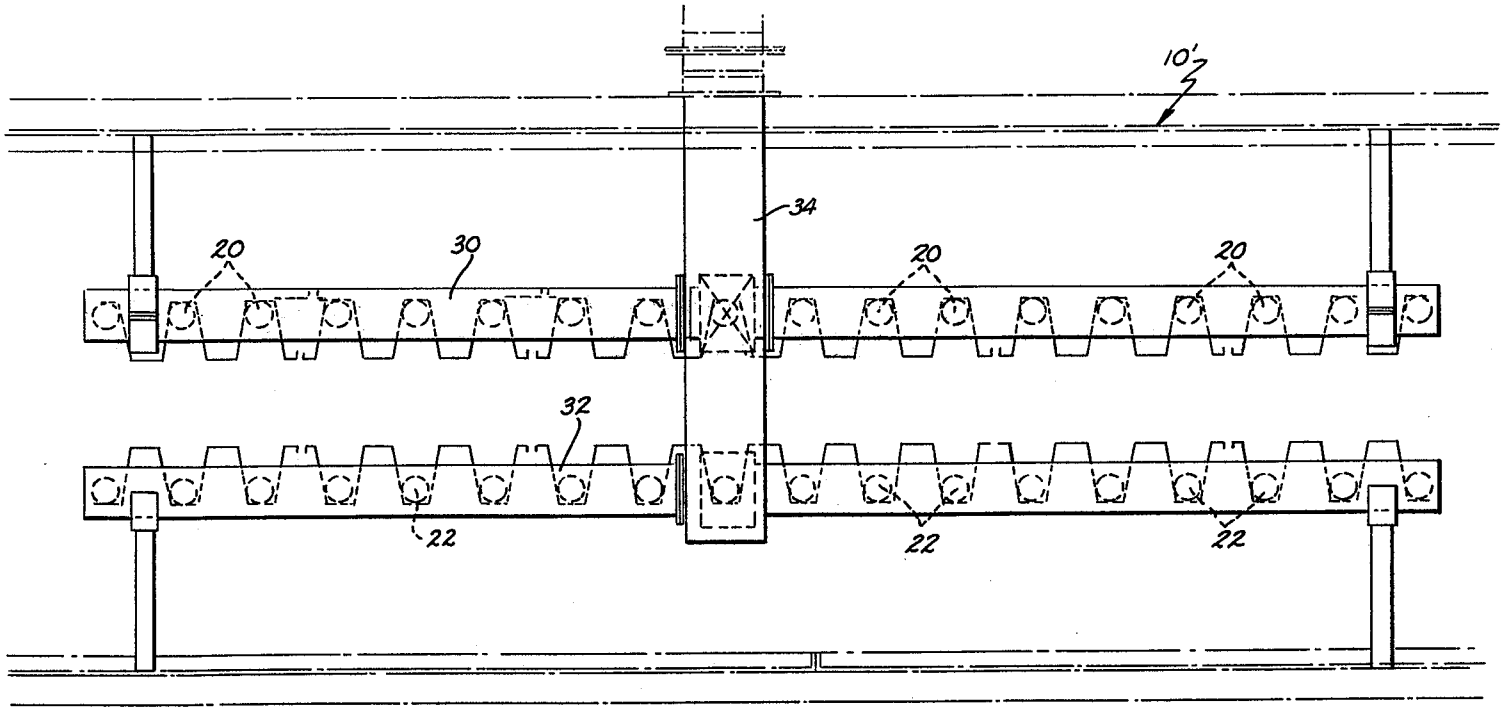
FIG. 4 is a fragmentary, side elevational view of the zone in FIG. 3.
Figure 1:
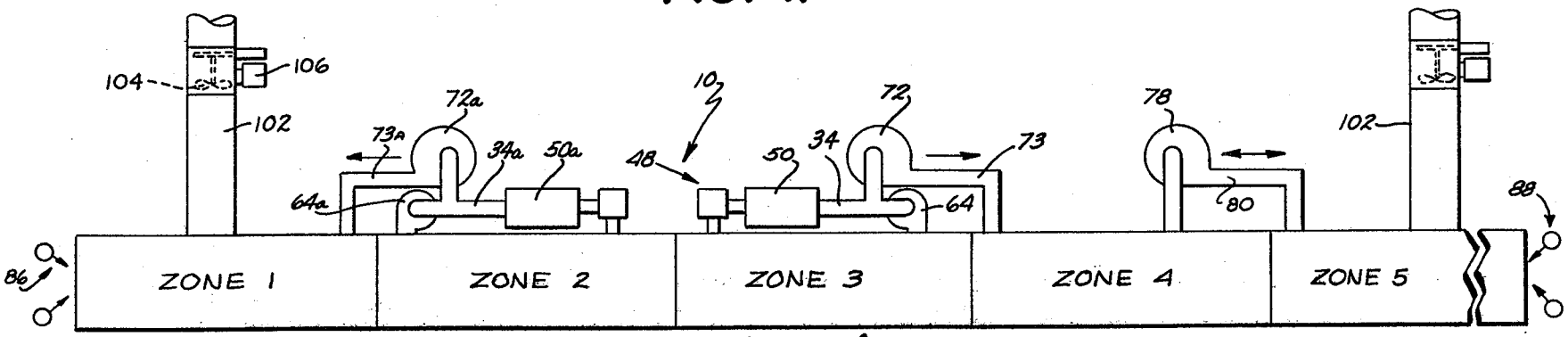
FIG. 1 is an elevational view of a five zone tentor apparatus employing the invention.

Experimentation with this multiple zone tentor showed that by conversion of two of the zones in the central portion of a conventional seven zone tentor in accordance with the present invention, only five zones total were needed in the tentor 10 (FIG. 1) to obtain equal or superior production output to a conventional eight zone tentor (as in FIG. 5), at greatly reduced heat consumption, as well as simultaneously achieving pollution control. Since the first and last zones were not employed, FIG. 1 is shown with the remaining five zones only, numbered consecutively as 1–5. Zones 2 and zone 3 of the apparatus (as depicted in FIG. 1) employ the novel concept, zone 3 being shown in FIG. 3 in cross section for illustration purposes, with zone 2 being basically identical therewith.

Figure 2:
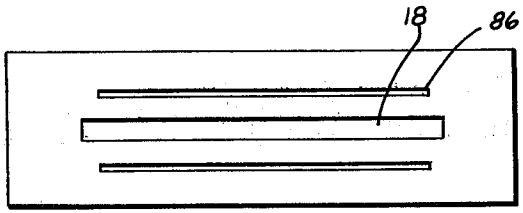
FIG. 2 is an end elevational view of the input end into zone 1 of the apparatus in FIG. 1.
Figure 3:
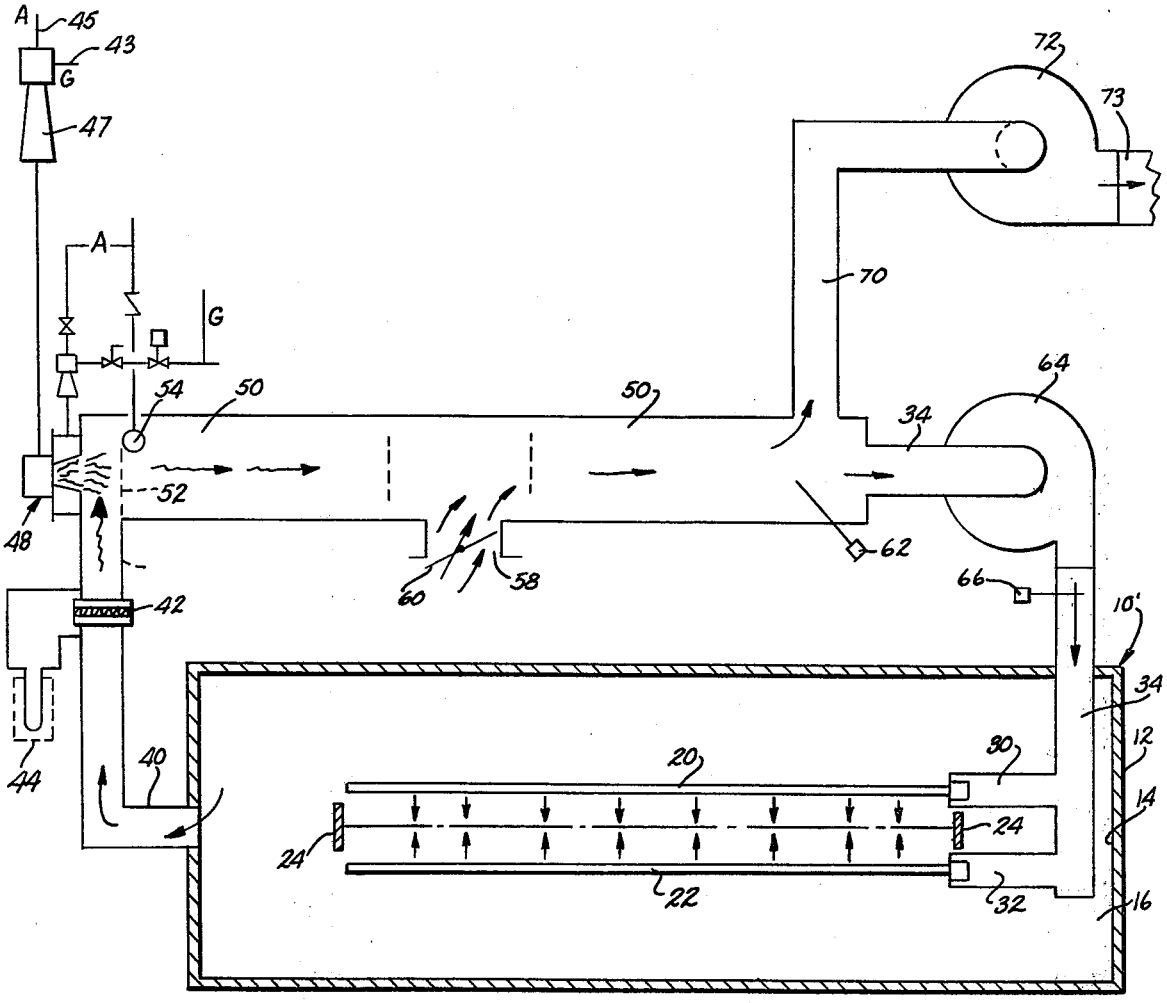
FIG. 3 is a sectional, end, partially schematic view of one of the zones in FIG. 1.

Each of the five zones, e.g. zone 3 shown at 10' in FIG. 3, includes a housing 12 of generally rectangular cross section, lined with insulation 14 and defining an internal chamber 16 having an opening on both the inlet and outlet ends comparable to the inlet opening 18 for zone 1 shown in the end view of FIG. 2. The web stock that passes through these chambers successively, (indicated by phantom line W in FIG. 3), is straddled above and below by a series of hot gas manifolds or pipes 20 and 22 respectively which project laterally, i.e., transversely of the stock direction of travel. From orifices in these manifolds, hot gases are ejected downwardly and upwardly respectively, onto and through the fabric stock as the advancing stock is held in a stretched condition in conventional fashion by typical tentor hooks or the equivalent. The tentor hooks are on supports 24 at the opposite edges of the web stock. Manifolds 20 and 22 are mounted to and in flow communication with conduits 30 and 32 respectively, both connected to and receiving hot gases from a common supply conduit 34. These components 20, 22, 30, 32 and 34 are conventional, as are the tentor hooks and supports 24. However, instead of the hot gases being vented directly to the atmosphere through exhaust stacks as is conventionally done, such gases, containing substantial quantities of evaporated water and vaporized oil and related solvent products, are specially processed, resulting in significant advantages.

Specifically, the hot gases emitted from manifold pipes 20 and 22 engage and pass through and over the moving stretched fabric, and then, laden with vaporized material, flow out return duct 40 and preferably through a filter 42 across which an indicating manometer 44 may be mounted to measure the pressure drop at the filter. The hot gases in the 300° F. plus range contain substantial quantities of combustible vapor, largely oil and solvents, as well as moisture. The oil, solvent, and carrier substances are combustible at temperatures above about 600° F., and often temperatures in the range of about 1400° F. The oils actually have kindling temperatures below 600° F. but the organic carriers usually have kindling temperatures above 600° F. But, temperatures this high cannot be tolerated in the oven since such would seriously damage the cloth being treated. According to the present concept, these gases are passed in front of an elongated high velocity burner assembly 48, as of the type set forth at FIG. 3 and described in column 6, Second Form, of U.S. Pat. No. 3,436,065, and also at 38 in U.S. Pat. No. 3,744,963, specifically incorporated by reference herein. Burner assembly 48 is supplied with a mixture of gaseous fuel and air from mixer 47 to which air line 45 and gas line 43 connect. The burner causes the combustion of the vaporized combustible oils and solvents, the temperature thereof being raised to the incineration range, i.e., above 600° F. in plenum 50. A grid 52 adjacent the burner may be used to assist in effective dispersal for efficient combustion. Adjacent the grid and burner assembly 48 is an elongated air supply manifold 54 having a series of orifices for directing air jets into the gaseous flow from the burner. This accomplishes two things, namely, supplying oxygen for combustion of the oil and solvent substances in the event the circulated air becomes saturated with moisture and lacks oxygen, and secondly creating turbulence to thoroughly mix the hot gases from the burner with the recirculated gases from the oven and fresh air from manifold 54. This mixture of gases at combustion range temperatures is directed through plenum 50 which has, downstream from the burner, fresh cooler air inlet means 58 controlled by dampers 60. The introduced cool air controllably lowers the temperature of the gases back down to drying range temperatures, i.e., the range of about 350° to 375° F. The temperature is controlled to the highest that is tolerable in the oven for the particular fabric. The gas temperature is sensed for control by a suitable high limit temperature sensor 62 such as a thermocouple projecting into the plenum to prevent the temperature from exceeding the maximum allowed for the cloth. Part of these gases are then drawn by blower 64 into duct 34, which may also include an added temperature sensor 66. Sensor 66 operates a temperature controller to control temperature in the tentor frame. Sensor 66 could also be used to govern the amount of fresh air allowed through inlets 58 for regulating the temperature of the gases re-entering the oven. The less air that is allowed to enter through inlet 58, the higher the temperature is created in plenum 50 to maintain the temperature required at sensor 66.

As noted, part of the gases from plenum 50 are advanced by blower 64 back into the oven. The other part passes into duct 70, drawn by blower 72, for advancement either into a succeeding zone or a preceding zone of the assembly. More specifically, as depicted in FIGS. 1 and 3, this other part of the gases from plenum 50 of zone 3 passes through blower 72 and duct 73 into the succeeding zone 4 downstream, for heat treatment of the cloth passing through the tentor. In contrast, the like apparatus to that depicted in FIG. 3, as applied to zone 2 (FIG. 1), has part of the gases from plenum 50A returned back to zone 2 through conduit 34A and blower 64A, and part propelled into any one or more of the other zones, e.g. zone 1 through blower 72A and duct 73A for preheating the cloth stock as it passes through zone 1 to zone 2. Each of zones 1 and 4 includes a plurality of manifold elements (such as 20 and 22 in FIG. 3) for vertically straddling the cloth stock. The gases exhausted from zone 1 are passed up through an exhaust stack 102 (FIG. 1) containing a conventional exhaust fan 104 and motor 106 therefor. The gases exhausted from zone 4 are shown transferred by blower 78 through conduit 80 to zone 5. The exhaust from zone 5 is conducted out through an exhaust stack 102. The number of gaseous recycle subassemblies as in FIG. 3, the particular location of the stacks, and arrangement of the conduits for flow from one zone to another can be varied to suit the circumstances, equipment, components and fabric conditions at the mill involved.

The embodiment set forth in FIGS. 1 and 3 involves recirculation of all of the gases from the selected oven zones to the combustion chamber and back to the oven. However, in some instances it may be desirable to recirculate only a fraction of the gases from the particular zone to the combustion chamber as explained relative to the embodiment in FIG. 6.

Preferably, air curtain units 86 and 88 are employed at the entrance to the first zone and at the exit to the last zone, these being for example of the type disclosed in more detail in U.S. Pat. No. 3,744,963 at 22 and 24. This helps to lessen hot gas flow out the inlet and exit for the stock.

Extensive experimentation with this apparatus has shown that, by converting two of the conventional tentor zones of a conventional eight zone assembly, to employ the invention herein, the same production output can be achieved using only five zones in lieu of the previously required eight zones. Further, as close as can be determined, fuel savings over 30% have been achieved. It is expected that savings as high as 60% can be achieved in some installations. The amount of hot gases exhausted to the atmosphere is drastically cut to a small fraction of that previously exhausted, i.e., in the range of about 25 to 30%. For example, in the experimental apparatus, 1500 cubic feet per minute of gases were handled, per zone, instead of the previous 8000 cfm per zone. In fact, the exhaust rate is considerably less than that even tolerable in previous units because such a low exhaust rate would have dictated low gas flow rates that would have resulted in the vaporized oil and solvent products recondensing in the equipment and on the textile material. With the novel apparatus, these undesirable solvent and oil materials are actually taken advantage of, by combusting them using the burner assembly at the added plenum of the recycle system, to clean up the gases as well as achieving significant heat conservation therefrom. Thus, the significantly smaller fraction of gases that are actually exhausted are basically free of the oil and solvent substances. If it were attempted to combust the volatiles carried in the gaseous flow mass of the prior art, the amount of heat necessary to simply heat up the tremendous amount of gases, e.g. 6000 to 8500 cfm, would be greater than the entire amount of heat otherwise needed for the process of drying and heat treating.

The results of the invention therefor are increased production and/or lower capital equipment costs and requirements, significantly greater heat conservation, with concomitant less fuel consumption and pollution control.

Another operating criterion for tentor frames is that the faster the textile fabric can effectively advance through it, the greater the efficiency thereof. Using the invention, rates of fabric feed can be increased by over 30% and often considerably more, yet with effective drying and heat treating, thereby increasing efficiency per pound of fabric processed as well as production output. Tentors presently in use can be converted to employ the invention without significant difficulty or great expense, resulting in significantly improved operation and savings.

Figure 6:
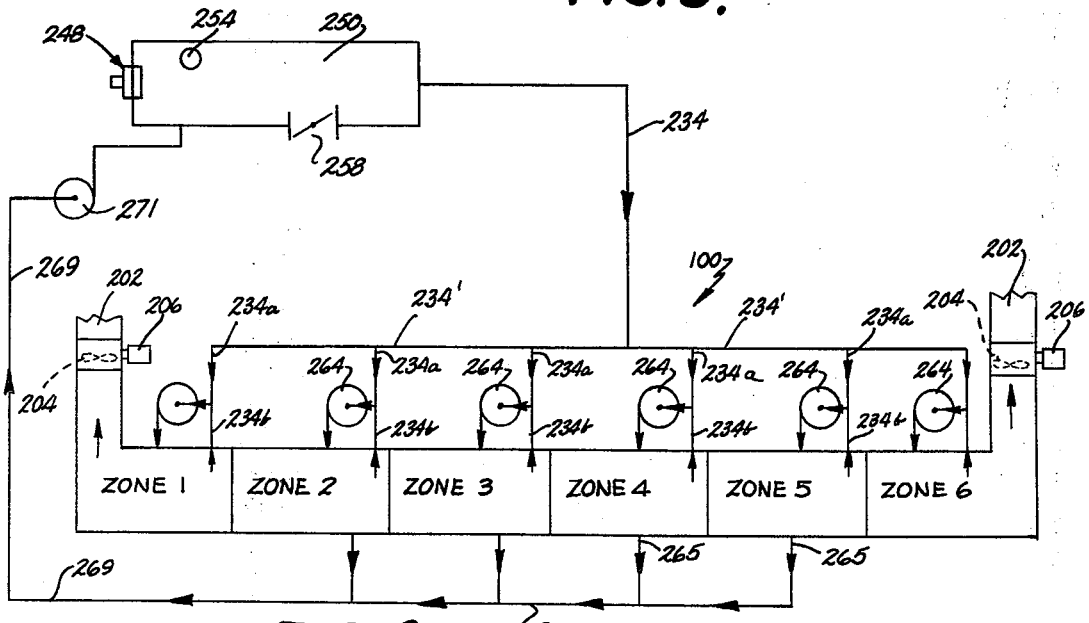
FIG. 6 is a schematic diagram of a second embodiment of the concept.

Referring to FIG. 6, a second embodiment of the invention there shown as assembly 200 has a plurality of six oven zones with an elongated passage through which web stock entering one end of the oven passes before exiting at the other end of the oven. Each zone includes a chamber in which volatilizable material is removed from the stock and/or the stock is heat treated by flow of hot gases. Burner 248 and plenum 250 into which it fires has a combination effect with a plurality of zones, specifically all six in the depicted version. As shown, a portion of the hot gases in each of zones 1–6 is recirculated while the other portion is conducted to the burner (zones 2–5) or to a stack (zones 1 and 6). The gaseous portion that is recirculated is mixed with the incinerated gases from the burner plenum at re-entry into the oven. The incinerated gases may be conducted back to the oven zones through a manifold arrangement. And, the gaseous portion removed may be conducted through a manifold arrangement to the burner.

More specifically, hot incinerated gases at a controlled temperature from plenum 250 are conducted through duct 234, which leads into manifold 234' and into branch ducts 234a to respective blowers 264. The blowers also receive a portion of the gases and vapors from the oven zones through ducts 234b. The mixture of gases is forced into the individual oven zones to the web stock. As to the intermediate zones 2–5, the other portion of the gases and vapors are ducted through exit ducts 265 into manifold 267 to exhaust duct 269 in which a supplemental blower 271 operates to propel these gases and vapors to burner 148 for incineration of the combustible volatilized vapors at temperatures in the range of about 450° F. to about 1400° F. Supplemental air is ejected through outlets 254 adjacent burner 248 for oxygen supply and turbulence generation. A controlled amount of ambient temperature air is allowed to enter the plenum past the valve at inlet 258 to lower the temperature of the mixture of gases flowing therepast to that tolerable for the material treated in the oven prior to re-entry of the gases into selected oven zones. The lowered temperature of the hot gases will vary, depending upon the material, but for cloth will typically be about 350° F. to 375° F.

A portion of the gases in the end zones 1 and 6 is ejected out the respective stacks 202 under the influence of blowers 204 operated by motors 206, rather than recirculated. Thus, there is constant incineration of the combustible material in a portion of the gases and constant venting of a graduated amount. The blowers 264 recirculate the hot gases in the zones while pulling sufficient incinerated gaseous products from the plenum 250 to maintain temperature and replace gases being drawn out of the oven, mainly up the stacks. If desired, an additional stack can connect to one of the intermediate zones.

For example, if 1500 cubic feet per minute (cfm) is circulated in each zone, about 300 cfm or so could be withdrawn to the incineration burner, incinerated, cooled to a lower elevated temperature and returned. Surplus from the intermediate zones could be supplied to the zones from wherein the gases contain no pollutants such as the first zone and the last zone.

To be certain the ratio of organic carriers commonly employed for cloth dyes to air is kept well below the explosive range, sufficient dilution of noncombusted carriers is practiced by controlled entry of air. Specifically, the dilution factor is kept in the range of 3 to 1 up to 20 to 1 of air to carrier.

Although the specific illustrative embodiments depicted employ gaseous fuel for direct heating in the chamber, other fuels such as coal, coke or heavy oils could conceivably be employed as for indirect heating of the chamber to an incineration temperature. Or, electrical heat could be utilized in some instances or as an emergency standby.

Once the inventive concept is understood, it will be realized by those in the art that details of the illustrative arrangement can be modified to suit a particular installation, type of textile, size of mill, and other factors, the illustrative version depicted being exemplary of the concept.

The embodiments of the invention in which an exclusive property or privilege is claimed are defined as follows.

1. A multiple zone oven apparatus for heating web stock to drive off volatilizable, combustible materials, comprising:

a plurality of oven zones including an entry zone for preheating web stock, an exit zone, and one or more intermediate zones for volatilizing material from web stock, all having passage means for conveyance of web stock therethrough;

gaseous outlet means into said oven for gases at elevated volatilizing temperatures;

gaseous incineration and recycle means including burner means for combusting volatilized material and increasing the temperature thereof to incineration temperatures; duct means from said intermediate zones of said oven to said burner means to conduct material laden gases from said intermediate zones of said oven to said burner means for incineration; second duct means from said burner means back to said oven through said gaseous outlet means, and arranged for conducting at least part of the recycled gases back to said entry zone; and cool air inlet means in said second duct means to lower the elevated temperatures of the gases from incineration temperatures to volatilizing temperatures before re-entry into said oven.

2. The oven apparatus in claim 1 including recirculatory means for said zones to cause the gases at volatilizing temperatures to be recirculated; said second duct means communicating with said recirculatory means for supplementing recirculated gases with incineration gases from said burner means.

3. The oven apparatus in claim 2 including exhaust stack means for at least one of said entry and exit zones for exhausting a portion of the gases from said oven.

4. The oven apparatus in claim 3 including manifold means from said zones for said duct means to said burner means.

5. A multiple zone oven apparatus for heating web stock to drive off volatilizable, combustible materials, comprising:

a plurality of oven zones having passage means for conveyance of web stock therethrough;

gaseous outlet means into said oven for gases at elevated volatilizing temperatures;

gaseous incineration and recycle means including burner means for combusting volatilized material and increasing the temperature thereof to incineration temperatures; duct means from said oven to said burner means to conduct material laden gases from said oven to said burner means for incineration; second duct means from said burner means back to said oven; cool air inlet means in said second duct means to lower the elevated temperatures of the gases from incineration temperatures to volatilizing temperatures before re-entry into said oven; recirculatory means for said zones to cause the gases at volatilizing temperatures to be recirculated; said second duct means communicating with said recirculatory means for supplementing recirculated gases with incineration gases from said burner means; exhaust stack means for at least one of said zones for exhausting a portion of the gases from said oven; said recirculatory means comprising a series of blowers, for the respective zones, and manifold means for said second duct means for ducting incineration product gases from said burner means to said series of blowers.

6. A multiple section tentor for treating cloth stock to drive off volatilizable residual materials thereon, including an entry section, an exit section, and at least one intermediate section;

tentor means for conveyance of cloth stock through said tentor by passage into and through said entry section, through said intermediate sections, and through and out of said exit section; at least one of said intermediate sections having gaseous recycle means;

said gaseous recycle means including a gaseous outlet from said intermediate section for flow of a stream of hot gases laden with volatilized materials from the cloth stock treated, a gaseous inlet back to said intermediate section, and a conduit from said gaseous outlet to said gaseous inlet;

burner means in said conduit for increasing the gaseous temperature by combusting volatilized materials in the gaseous stream from said gaseous outlet;

supplemental air inlet means to said conduit, downstream of said burner means for entry of cool air to lower the temperature of the gaseous stream;

supplemental air control valve means at said supplemental air inlet means for regulation of cool air entry to said conduit;

said conduit downstream of said supplemental air inlet means having split flow branches, one branch being to said gaseous inlet to said one intermediate section and the other branch comprising an input conduit to another one of said sections; and branch flow control valve means for regulation of gaseous flow into respective ones of said branches.

7. The tentor in claim 6 including an air inlet manifold adjacent said burner means for supplying oxygen for combustion.

8. The tentor in claim 6 wherein said split flow exhaust branch comprises an input to a section through which the web stock is conveyed prior to said one section, for preheating of the cloth stock.

9. The tentor in claim 6 wherein said split flow exhaust branch comprises an input to a section through which the web stock is conveyed subsequently to said one section, for post heating of the cloth stock.

10. A multiple section oven for heat treating web stock to drive off volatilizable and combustible residual materials thereon, including an entry oven section, an exit oven section, and at least one intermediate oven section;

means for conveyance of web stock through said oven by passage into and through said entry oven section, through said intermediate oven sections, and through and out of said exit oven section; at least one of said oven sections having gaseous recycle means;

said gaseous recycle means including a gaseous outlet from said oven for flow of a stream of hot gases laden with volatilized materials from the stock treated, a gaseous inlet back to said oven, and a duct from said gaseous outlet to said gaseous inlet;

burner means in said duct for increasing the gaseous temperature by combusting volatilized materials in the gaseous stream from said gaseous outlet;

supplemental cool air inlet means to said duct, downstream of said burner means for entry of cool air to lower the temperature of the gaseous stream;

supplemental air control valve means at said supplemental cool air inlet means for regulation of cool air entry to said duct;

said duct downstream of said supplemental air inlet means having split flow branches, one branch being to said gaseous inlet to said one intermediate section and the other branch being exhaust; and branch flow control valve means for regulation of gaseous flow into respective ones of said branches.

11. The oven in claim 10 wherein said gaseous outlet is from at least one of said intermediate oven sections, and said split flow exhaust branch comprises an input duct to another one of said oven sections.

* * * * *